US005351114A

United States Patent [19]

Matsuno

[11] Patent Number: 5,351,114

[45] Date of Patent: Sep. 27, 1994

[54] ELECTROPHOTOGRAPHIC COPYING APPARATUS HAVING RIBBON-SHAPED TONER IMAGE CARRIER

[75] Inventor: Junichi Matsuno, Toride, Japan

[73] Assignee: Hitachi, Ltd., Tokyo, Japan

[21] Appl. No.: 870,297

[22] Filed: Apr. 17, 1992

[30] Foreign Application Priority Data

Apr. 22, 1991 [JP] Japan ..... 3-090552
Jun. 26, 1991 [JP] Japan ..... 3-154350

[51] Int. Cl.[5] ..... G03G 15/20
[52] U.S. Cl. ..... 355/285; 355/274; 355/290
[58] Field of Search ..... 355/271, 274, 275, 277, 355/279, 280, 282, 285, 289, 284, 290; 219/216

[56] References Cited

U.S. PATENT DOCUMENTS

| | | | |
|---|---|---|---|
| 4,420,243 | 12/1983 | Baker et al. | 355/315 |
| 4,435,067 | 3/1984 | Draai et al. | 355/77 X |
| 4,780,742 | 10/1988 | Takahashi et al. | 219/216 X |
| 4,912,514 | 3/1990 | Mizutani | 355/272 |
| 4,985,733 | 1/1991 | Kurotori et al. | 355/282 |
| 5,057,875 | 10/1991 | Itoh | 355/326 |
| 5,115,278 | 5/1992 | Maruta et al. | 355/285 |

FOREIGN PATENT DOCUMENTS

| | | |
|---|---|---|
| 406892A2 | 6/1990 | European Pat. Off. . |
| 4003695A1 | 7/1990 | Fed. Rep. of Germany . |

OTHER PUBLICATIONS

Patent Abstracts of Japan P-1195, Apr. 25, 1991 vol. 15/No. 166.
Patent Abstracts of Japan P-603 Aug. 8, 1987 vol. 11/No.243.
Patent Abstracts of Japan P-1191 Apr. 17, 1991 vol. 15/No. 153.

*Primary Examiner*—Leo P. Picard
*Assistant Examiner*—Christopher Horgan
*Attorney, Agent, or Firm*—Antonelli, Terry, Stout & Kraus

[57] ABSTRACT

An electrophotographic apparatus has a heat-resistant endless belt having a portion which runs from a transfer position to a heat-fixing position, a driving drum for driving the endless belt, a transfer roller for transferring, at the transfer position, a toner image of information to be recorded from a photosensitive drum to the endless belt, a recording medium feed roller for feeding a sheet-type recording medium to the heat-fixing position, and a heater and a pressure roller which are disposed in the heat-fixing position and cooperative to transfer the toner image from the endless belt to the recording medium. The heater is disposed on the inner side of a loop of the endless belt, while the pressure roller is disposed outside the loop. The photosensitive drum, endless belt, transfer roller and heater are mounted on a common frame which is demountable from the frame of the apparatus. The pressure roller is mounted on the apparatus frame so as to be movable towards and away from the endless belt, thereby facilitating mounting and demounting of the common frame.

21 Claims, 6 Drawing Sheets

ELECTROPHOTOGRAPHIC COPYING APPARATUS HAVING RIBBON-SHAPED TONER IMAGE CARRIER

BACKGROUND OF THE INVENTION

1. Field of the Invention

The present invention relates to an electrophotographic copying apparatus and, more particularly, to an electrophotographic copying apparatus which can perform, in a single step of operation, both transfer of a toner image to a sheet-type recording medium and fixing of the toner image to the recording medium.

2. Description of the Prior Art

As disclosed in Japanese patent Laid-Open Publication No. 2-157883, a typical known electrophotographic copying apparatus has transfer means for transferring a toner image formed in a recording section onto a recording medium such as recording paper, and fixing means for fixing the transferred image to the recording medium, the transferring means and the fixing means being disposed independently at difference locations. The transfer means causes the toner image to be attracted by the paper with a small electrostatic force, and the paper thus holding the tone image with a small force is conveyed to the fixing means. Consequently, a slip tends to occur between the toner particles forming the toner image and the paper during conveyance of the paper from the transfer means to the fixing means, resulting in a degradation or distortion of the image.

Another problem encountered with the known apparatus is that, since the transfer means and the fixing means are disposed separately, the toner image tends to be distorted due to inertia of the toner particles when the leading end of the paper is caught in the fixing means, as a result of difference between the paper transporting speed of the fixing means and that of the fixing means.

In the known electrophotographic copying apparatus, the above-mentioned difference in the paper transporting speed is absorbed by a slack or bend of the paper in the region between the transfer means and the fixing means. Consequently, a considerably large distance is essentially required between these two means, which undesirably increases the size of the whole apparatus.

In addition, copying of image to a recording medium comprising a plurality of sheets, e.g., a notebook, has been practically impossible with the known copying apparatus due to difficulty encountered in conveying such a medium from the transfer means to the fixing means.

Furthermore, in the known electrophotographic copying apparatus, the transfer means and the fixing means are independently mounted on the frame of the apparatus, and so is a developing means for forming the toner image. Consequently, these means have to be handled separately during, for example, maintenance work.

The known electrophotographic copying apparatus of the kind described above, having the developing means, transfer means and fixing means constructed as separate units, suffers from the problem that, since these units have their own periods of maintenance or renewal, the period of the maintenance or other work conducted on the whole apparatus is shorter than that for each of these units. In addition, a troublesome adjusting work is often required to keep these units in good relation to each other in order to maintain a high quality of the copy image.

To discuss this problem in greater detail, assuming here that an electrophotographic copying apparatus has three units: a first unit which is to be renewed for every 10,000 copies, a second unit which is to be renewed for every 15,000 copies and a third unit which is to be renewed for every 20,000 copies. Thus, the lives of the first, second and third units expire when they have been operated to make 10,000 copies, 15,000 copies and 20,000 copies, respectively. Consequently, the second unit has to be renewed after the production of only 5,000 copies after a maintenance work which was conducted for renewing the first unit after production of the initial 10,000 copies. If the expected performance of the copying apparatus has not been recovered despite the renewal of the second unit, the user will be at a loss as to what should be the cause and may attempt to renew the first and/or third units even though the lives of the first and third units have not yet been expired. Consequently, the period of the maintenance is shortened to 5,000 in terms of the number of copies produced. Needless to say, such a frequent renewal of units leads to wasteful use of these units.

In addition, delicate adjustment of the units in relation to each other, which has to be done each time a separate unit is renewed, cannot be executed completely satisfactorily unless the adjustment is done in the factory in which the apparatus was produced or by a skilled maintenance engineer.

For these reasons, electrophotographic copying apparatuses in user's offices are not always used in their best conditions.

SUMMARY OF THE INVENTION

Accordingly, a first object of the present invention is to provide an electrophotographic copying apparatus in which transfer means for transferring a toner image to a recording medium and fixing means for fixing the toner image to the recording medium are constructed as one unit, thereby improving the quality of the copy image while reducing the size of the apparatus.

A second object of the present invention is to provide an electrophotographic copying apparatus which enables users to easily conduct maintenance work while minimizing wasteful use of the developing unit, transfer unit and the fixing unit, thus extending the period of maintenance of the whole apparatus as compared with known apparatus.

A third object of the present invention is to provide an electrophotographic copying apparatus which can cope with a comparatively large variation in the thickness of the recording medium.

According to one aspect of the present invention, there is provided an electrophotographic apparatus, comprising: a photosensitive member; developing means for forming, on the photosensitive member, a toner image of information to be recorded; transfer means for transferring the toner image from the photosensitive member to a ribbon-shaped toner image carrier; carrier driving means for driving the toner image carrier to a heat-fixing position; recording medium feeding means for feeding a sheet-type recording medium to the heat-fixing position; and transfer/fixing means disposed in the heat-fixing position for superposing the recording medium and the toner-image carrier one on the other and for applying heat and pressure to the toner image carrier and the recording medium thereby transferring the toner image from the toner-image carrier to the recording medium and fixing the transferred image to the recording medium.

In a preferred form of the present invention, the toner image carrier comprises a heat-resistant endless belt, and the image carrier driving means comprises a driving drum engaging with the inner surface of a loop of the heat-resistant endless belt.

The transfer/fixing means may include a heating means spaced from the driving drum and disposed adjacent the inner surface of the loop of the heat-resistant endless belt, and a pressure roller which is disposed to oppose the heating means so as to press the superposed sheet-type recording medium and endless belt against the heating means.

According to another aspect of the present invention, there is provided an electrophotographic apparatus, comprising: a photosensitive member; developing means disposed in a developing position and capable of forming, on the photosensitive member, a toner image of information to be recorded; first driving means for driving the photosensitive member from the developing position to a transfer position; a heat-resistant ribbon-shaped toner image carrier movable from the transfer position to a heat-fixing position; transfer means disposed in the transfer position for transferring the toner image from the photosensitive member to the toner image carrier; second driving means for driving the toner-image carrier from the transfer position to the heat-fixing position; recording medium feeding means for feeding a sheet-type recording medium into the heat-fixing position; and transfer/fixing means disposed in the heat-fixing position and operative to superpose the recording medium and the toner-image carrier one on the other and to transfer the toner image from the toner-image carrier to the recording medium and fix the thus transferred toner image to the recording medium, the transfer/fixing means including heating means disposed in contact with the surface of the toner-image carrier opposite to the image-carrying surface to heat the toner-image carrier, and a heat-resistant roller for pressing the recording medium onto the surface of the toner-image carrier.

The transfer/fixing means preferably includes pressing force adjusting means for adjusting the pressure between the toner-image carrier and the roller in accordance with at least one of the thickness of the recording medium and the smoothness of the surface of the recording medium.

The transfer/fixing means may preferably further include distance adjusting means for adjusting the distance between the heating means and the axis of rotation of the roller in accordance with the thickness of the recording medium.

According to still another aspect of the present invention, there is provided an electrophotographic apparatus, comprising: a photosensitive member; developing means disposed in a developing position and capable of forming, on the photosensitive member, a toner image of information to be recorded; driving means for driving the photosensitive member from the developing position to a transfer position; a heat-resistant endless belt having a run extending at least between the transfer position and a heat-fixing position; transfer means disposed in the transfer position for transferring the toner image from the photosensitive member to the toner image carrier; a driving drum disposed in engagement with an inner surface of a loop of the heat-resistant endless belt so as to drive, from the transfer position to the heat-fixing position, the run of the heat-resistant endless belt which has received the toner image; recording medium feeding means for feeding a sheet-type recording medium into the heat-fixing position; transfer/fixing means disposed in the heat-fixing position and operative to superpose the recording medium and the run of the heat-resistant endless belt one on the other and to transfer the toner image from the toner-image carrier to the recording medium and fix the transferred toner image to the recording medium; and control means for controlling the operations of the driving means, the driving drum and the recording medium feeding means; the transfer/fixing means including heating means disposed in contact with the surface of the toner-image carrier opposite to the image-carrying surface to heat the toner-image carrier, and a heat-resistant roller for pressing the recording medium onto the outer surface of the loop of the heat-resistant endless belt.

The heating means may include an electrically energizable heat-generating member, and the control means may include a timing sensing means for sensing the passage of the recording medium through the heat-fixing position and controls the operation of the heat-generating member in a timed relationship with the sensed passage of the recording medium. The control means may preferably include a size sensing means for measuring the dimension of the sheet-type recording medium in the direction transverse to the feeding direction and controls the heat-generating region of the heat-generating member in accordance with the size of the recording medium as measured by the size sensor.

The electrophotographic apparatus of the invention may further include cooling means for cooling the portion of the heat-resistant endless belt which has passed through the heat-fixing position. The control means may further include a temperature sensor for sensing the temperature of the run of the heat-resistant endless belt between the heat-fixing position and the transfer position, the control means suspending the operations of at least the developing means and the heating means when the temperature sensed by the temperature sensor is higher than a predetermined temperature level.

According to a further aspect of the invention, there is provided an electrophotographic apparatus, comprising: a photosensitive drum; a developing device for forming, on the photosensitive dry, a toner image of information to be recorded; a heat-resistant endless belt having a run extending from the transfer position to a heat-fixing position; a transfer roller for transferring the toner image from the photosensitive drum to the heat-resistant endless belt; a driving drum engaging with the inner surface of a loop of the heat-resistant endless belt so as to drive, from the transfer position to the heat-fixing position, the run of the heat-resistant endless belt which has received the toner image; recording medium feeding means for feeding a sheet-type recording medium to the heat-fixing position; and transfer/fixing means disposed in the heat-fixing position and operative to superpose the sheet-type recording medium and the run of the heat-resistant endless belt one on the other and to transfer the toner image from the heat-resistant endless belt to the sheet-type recording medium and fix the transferred image to the sheet-type recording medium, the transfer/fixing means including heating means disposed in contact with the inner surface of the loop of the heat-resistant endless belt to heat the heat-resistant endless belt; wherein the photosensitive drum, the heat-resistant endless belt, the transfer roller, the driving drum and the heating means are mounted on a common frame which is detachable from the frame of the apparatus.

The transfer/fixing means may preferably further include disengaging means for disengaging the pressure roller from the endless belt before the common frame is demounted from the frame of the apparatus.

The above and other objects, features and advantages of the present invention will become more apparent from the following description with reference to the accompanying drawings.

DESCRIPTION OF THE PREFERRED EMBODIMENTS

Figure 1:
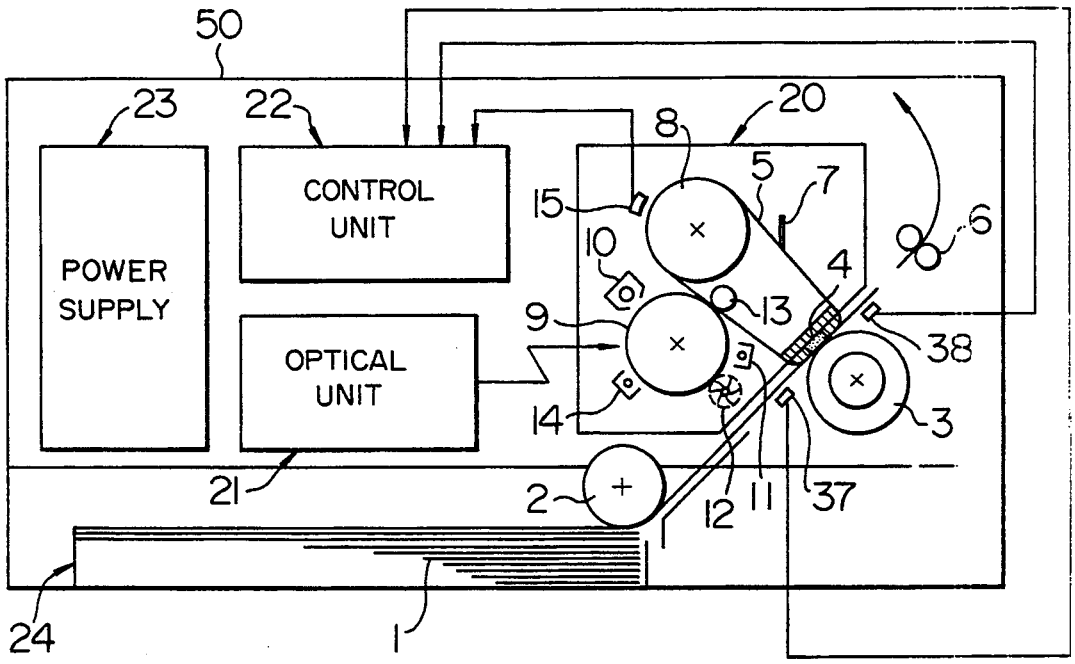
FIG. 1 is a schematic side elevational view of an embodiment of an electrophotographic copying apparatus in accordance with the present invention.
Figure 2:
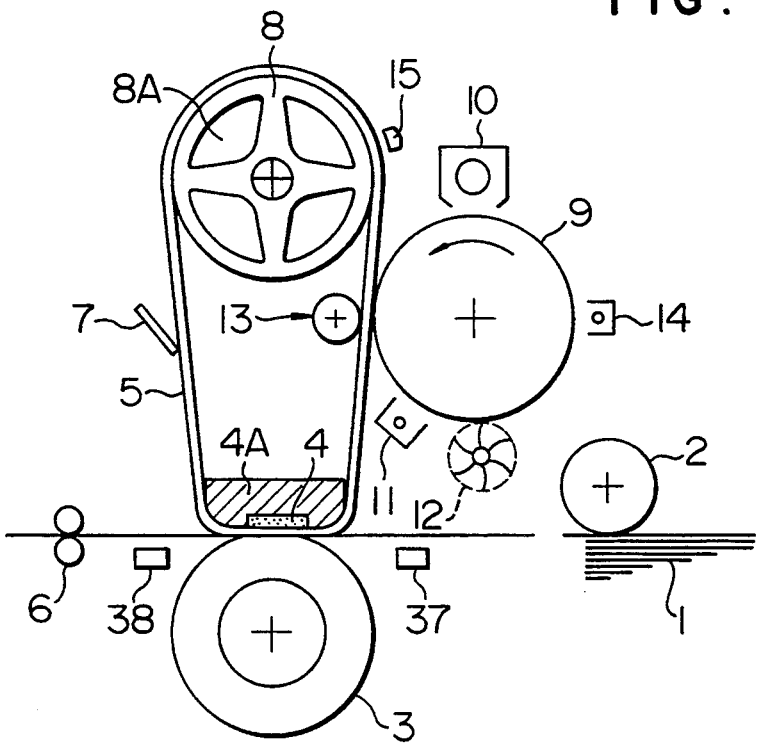
FIG. 2 is a schematic illustration of a recording section of the electrophotographic copying apparatus shown in FIG. 1.

A first embodiment of the present invention will be described with specific reference to FIGS. 1, 2 and 3.

An electrophotographic copying apparatus as the first embodiment includes an optical unit 21, a recording section 20, a paper hopper 24, a control unit 22 for controlling these components, a power supply 23, and so forth. All these components 20, 21, 22, 23 and 24 are housed in a housing 50 of the apparatus.

A paper feed roller 2 is disposed on the paper outlet side of the paper hopper 24 and feeds sheets of paper to the recording section 20 one after another from a stack of paper sheets in the hopper 24. The optical unit 21 has a function to irradiate, with a slit light, a photosensitive drum 9 as a photosensitive member in the recording section 20, thereby forming an electrostatic latent image on a photosensitive layer of the drum 9.

The photosensitive drum 9 has a coating layer made of an organic photosensitive material and is driven to rotate about an axis at a predetermined speed. A charger 14 uniformly charges the photosensitive layer of the photosensitive drum 9 into positive or negative polarity. A developing device 10 supplies the photosensitive surface of the photosensitive drum 9 with a toner so as to develop the electrostatic latent image on the photosensitive surface into a visible toner image. A transfer roller 13 for pressing a heat-resistant belt 5 against the photosensitive drum 9 opposes the latter through the belt 5, so that a toner image is transferred from the photosensitive drum 9 to the heat-resistant belt 5. In order to maintain a good state of contact between the heat-resistant belt 5 and the photosensitive drum 9, the roller 13 is preferably covered with, for example, an elastic material. The heat-resistant belt 5 may be formed, for example, from a metallic belt and is coated with a fluororesin alone or a mixture of a fluororesin and another resin having a high resistivity. It is possible to use a polyimide film in place of the metallic belt, with a surface coat of a fluororesin.

In this embodiment, a heat generating-member 4 as a heating means and a pressure roller 3 opposing the heat-generating member 4 in combination form transfer/fixing means. More specifically, the heat-resistant belt 5 and a paper sheet 1 are caused to pass through the nip between the pressure roller 3 and the heat-generating member 4 so that the toner image carrier by the heat-resistant belt 5 is transferred and fixed to the paper sheet 1. The heat-generating member 4 is, for example, a PTC heater (Positive Temperature Coefficient heater), and is held by a holder 4*a*. Preferably, the pressure roller 3 is covered with an elastic material or made from a heat-insulating elastic material in order to provide a good state of contact between the heat-resistant belt 5 and the heat-generating member 4. The heat-generating member 4 and the pressing roller 3 are so designed and constructed that the area of contact between the pressing roller 3 and the paper 1 is at least equal to the area of the region on the heat-generating member 4 where the temperature is higher than the toner fixing temperature. The heat-generating region of the heating means is set in conformity with the path of the paper sheets 1 past the heat-generating member 4.

The heat-resistant belt 5 is an endless belt which extends between and around the above-mentioned holder 4A holding the heat-generating member 4 and a driving drum 8 so as to be driven by the latter. A pair of ejecting rollers 6 are disposed downstream of the transfer/fixing means and receive the paper sheet 1 carrying the fixed image and deliver it to a stacker. A charge remover 11 removes any residual toner image remaining on the photosensitive drum 9 after the transfer of the toner image from the photosensitive drum 9 to the heat-resistant belt 5. A cleaner 12 is disposed in the vicinity of the charge remover 11 and collects any toner particles after the charge removal performed by the charge remover 11, thereby cleaning the surface of the photosensitive drum 9. A scraper 7 is disposed so as to contact the heat-resistant belt 5 at a position downstream of the transfer/fixing region and scrapes residual toner off the heat-resistant belt 5 after the transfer.

Figure 3:
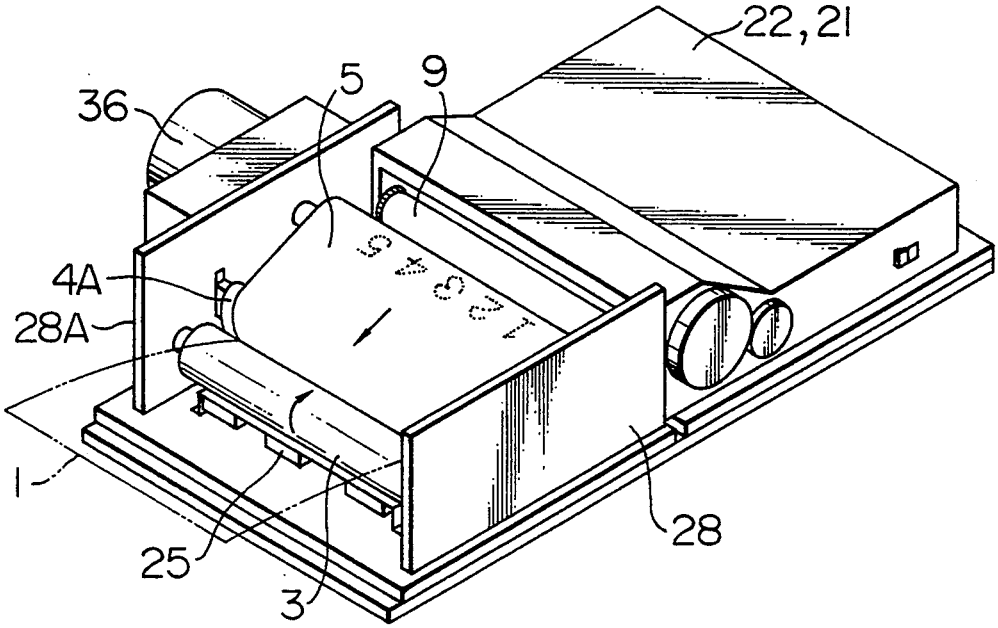
FIG. 3 is a perspective view of the electro-photographic copying apparatus of FIG. 1, with a housing removed to show the internal structure.

As will be seen from FIG. 3, the pressure roller 3, the driving drum 8, the photosensitive drum 9 and the transfer roller 13 are rotatably carried by a pair of frame walls 28 and 28A and are driven by a common driving motor 36.

The construction and operation of the recording section 20 will be described in greater detail with reference to FIGS. 1, 2 and 3.

Sheets of paper are fed by the paper feed roller 2 in one-by-one fashion into the transfer/fixing section. The transfer roller 13 operates to transfer, in a timed relation to the feed of a sheet of paper 1, the toner image from the photosensitive drum 9 to the heat-resistant belt 5 which is driven by the driving drum 8 in synchronization with the rotation of the photosensitive drum 9. In order to attain a high efficiency of image transfer from the photosensitive drum 9 to the heat-resistant belt 5, the transfer roller 13, which presses the heat-resistant belt 5 onto the photosensitive drum 9, is preferably covered with an elastic material. The elastic coating material on the transfer roller 13 may be a conductive material to which a bias voltage is applied, thus attaining a further improvement in the image transfer efficiency.

The portion of the heat-resistant belt 5 carrying the toner image transferred thereto is moved to the region where the heat-generating member 4 fixed to the holder 4A is located, as the heat-resistant belt 5 is driven by the driving drum 8. This portion of the heat-resistant belt 5, carrying the toner image electrostatically attracted thereto, is superposed to the paper sheet 1 which is fed by the paper feed roller 2, and is moved together with the paper sheet 1 into the nip between the heat-generating member 4 and the pressing roller 3 which is preferably made of a heat-insulating elastic material. Consequently, the image-carrying portion of the heat-resistant belt 5 is pressed against the paper sheet 1 at a pressure which is large enough to transfer and fix the image to the paper sheet 1. The control unit 22 shown in FIG. 1 controls the timings of operations of the optical unit 21, the photosensitive drum 9, the driving drum 8, the paper feed roller 2 and the heat-generating member 4 in such a manner as to register the paper sheet 1 with the position of the toner image carried by the heat-resistant belt 5.

The toner particles forming the toner image on the heat-resistant belt 5 are heated and melted by the heat applied by the heat-generating member 4, so that the toner image is transferred to the paper sheet 1 and simultaneously fixed thereto. The portion of the heat-resistant belt 5 from which the toner image has been transferred is further moved past the scraper 7 so that any residual toner is scraped off the belt 5, and is further moved past the driving drum 8 into the transfer region where the transfer roller 13 opposes the photosensitive drum 9, so as to receive a next toner image.

Thus, the heat-resistant belt 5 is required to electrostatically hold toner images repeatedly. In order to prevent any surplus toner particles from fusing and sticking to the heat-resistant belt 5, it is essential that the heat-resistant belt 5 is cooled sufficiently before entering again the region between the photosensitive drum 9 and the transfer roller 13. Usually, the heat-resistant belt 5 is naturally cooled as it moves from the transfer/fixing section to the driving drum 8, so that the temperature of the belt 5 is lowered. Such a natural cooling, however, may be insufficient. In order to ensure that the heat-resistant belt 5 is sufficiently cooled before entering the region where it receives toner image from the photosensitive drum 9, it is preferred to use, as the driving drum 8, a hollow drum with internal air passage bores 8A formed therein so that the heat-resistant belt 5 may be cooled. It is also effective to use a blower or the like which directs cooling air to the surface of the heat-resistant belt 5. An embodiment with such cooling means will be described later.

It is possible to arrange a temperature sensor 15 for measuring the temperature of the heat-resistant belt 5 before entering the toner-image receiving region where it receives the toner image from the photosensitive drum 9, and to control by the control unit 22 the operation of positive belt cooling means so as to cool the heat-resistant belt 5 down to a temperature which is low enough to avoid melting and sticking of toner particles to the belt 5, as well as degradation of the photosensitive drum 9 due to heat, e.g., down to 70° C. or lower, before the belt 5 enters the toner-image receiving region. It is also possible to arrange such that the controller 22 operates to suspend the copying operation when the temperature of the heat-resistant belt is raised above a predetermined temperature. To realize such a control, the temperature sensor 15 is electrically connected to the control unit 22.

The heat-resistant elastic pressure roller 3 may be an idle roller or may be power-driven independently. The force with which the pressing roller 3 is urged towards the heat-generating men%bet 4 may be controlled so as to be optimized for any thick recording medium such as a notebook or a stack of paper sheets 1. The arrangement also may be such that means are provided for measuring the dimension of the recording medium transverse to the direction of movement of the recording medium, so that the position and size of the heating area in the heating means are determined in accordance with the measured dimension of the recording medium, whereby transfer and fixing of the toner image to the recording medium can be performed without mis-registration regardless of the state of movement of the recording medium and the size thereof. An embodiment having such means will be described later.

Figure 4:
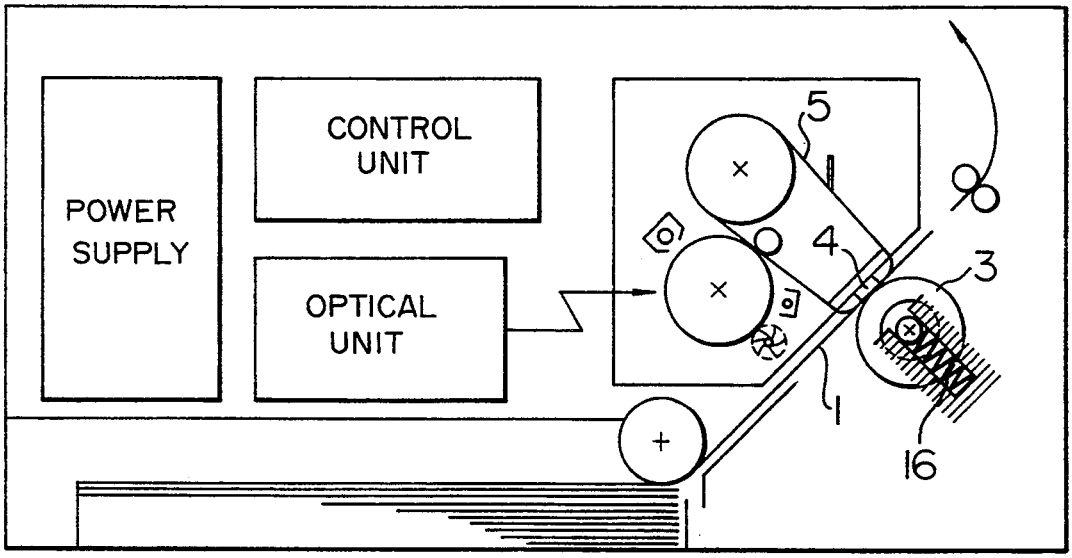
FIG. 4 is a view similar to FIG. 1 but shows a modification to the embodiment shown in FIG. 1.

FIG. 4 schematically shows the construction of a bankbook printer based on an electrophotographic printing technique. This printer has components which are substantially the same as those of the embodiment shown in FIGS. 1 to 3. In FIG. 4, therefore, such components are denoted by the same reference numerals as those appearing in FIGS. 1 to 3 and detailed description of such components is omitted. In this printer, the pressure roller 3 is supported by supporting means having a spring mechanism 16 as a pressure adjusting means, so that the pressure developed between the heat-generating member 4 and the pressure roller 3 is optimumly maintained regardless of any change in the type of the recording medium in terms of, for example, thickness, surface smoothness and so forth. Preferably, the spring mechanism 16 is controlled in accordance with signals given by sensors (not shown) which sense the thickness, smoothness and other factors of the recording medium.

In the case where the electrophotographic apparatus of the present invention is incorporated in a facsimile machine, the toner particles forming a toner image on the heat-resistant belt 5 are molten by the heat applied by the heat-generating member 4. The molten toner particles foxing the toner image are transferred and, simultaneously, fixed to a paper sheet 1. It is, therefore, possible to use a variety of types of paper sheets as the recording medium, e.g., reverse sides of commercial direct mail papers which are abundantly available in ordinary homes. It is also to be noted that the heat-generating member 4 need not be kept energized during a stand-by period since the heat-resistant belt 5 can be heated up to the fixing temperature without delay after energization of the heat-generating member 4 upon receipt of an image information transmitted to the facsimile machine.

Figure 5:
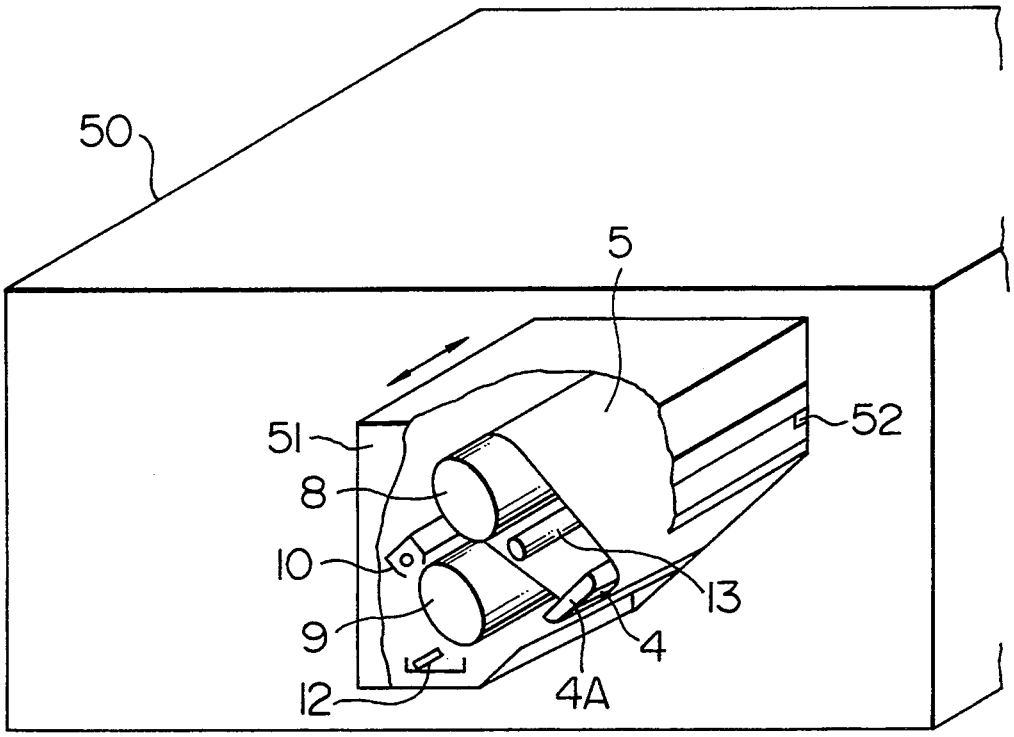
FIG. 5 is a perspective view of a critical portion of another embodiment of the electrophotographic copying apparatus in accordance with the present invention.
Figure 6:
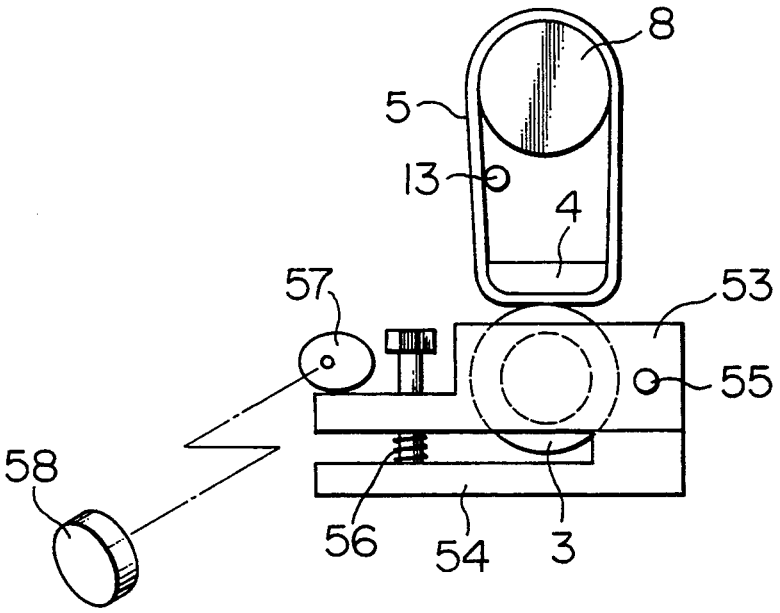
FIG. 6 is a schematic illustration of transfer/fixing means incorporated in the embodiment shown in FIG. 5.

FIGS. 5 and 6 show an embodiment which employs an assembly of the driving drum 8, the photosensitive drum 9, the heat-resistant belt 5, the heat-generating member 4 and holder 4A, the developing unit 10, the cleaner 12 and the transfer roller 13. This assembly is mounted on a unit frame 51 which is detachable from a housing 50 of the apparatus. In order to facilitate mounting and demounting operations, the unit frame 51 is provided with sliding members or rollers (not shown) which are adapted to slide or roll on guide rails 52 (only one of which is shown) provided in the housing 50.

Referring specifically to FIG. 6, the pressure roller 3 is rotatably supported at its both ends by a pair of roller support arms 53 which are pivotally secured, through pivot shafts 55, to a stay 54 fixed to the housing 50. Compression springs 56 are loaded between the roller support arms 53 and the stay 54 so as to urge the roller support arms 53 clockwise as viewed in FIG. 6, thereby normally urging the pressure roller 3 towards the belt 5, i.e., towards the heat-generating member 4. An eccentric cam 57 is rotatably mounted on the machine frame and contacts the end of each roller support arm 53 remote from the pivot shaft 55. The cam 57 is adapted to be rotatingly driven by, for example, an actuator 58. The actuator 58 is energized by a power controlled by the operator so as to drive the cam 57 before the unit frame 51 shown in FIG. 5 is demounted from the machine frame. Consequently, the roller support arms 53 are moved downward against the force of the springs 56, thus allowing the pressure roller 3 to leave the belt 5. Obviously, the actuator 58 for actuating the cam 57 may be substituted by a manual actuator such as a handle or a lever which can be manually operated by the operator.

Components mounted on the unit frame 51 which has been demounted from the machine frame are then adjusted or renewed. In this embodiment, the components are designed and constructed such that their lives are almost the same so that these components are simultaneously renewed as a unit. In order to realize the substantially the same lengths of lives of these components, it will be more economical to design such that the life of a component which is comparatively durable, e.g., the transfer belt, expires substantially concurrently with the expiration of a component which is less durable, e.g., the photosensitive member 9. Needless to say, however, it is important that the design be made such that the total cost is reduced while extending the lives of the components. Usually, the manufacturers are responsible for any trouble which would make the apparatus unusable much earlier than the expiration of expected period of maintenance due to, for example, an inferior initial setting. The design, therefore, should not take such trouble into consideration.

The unit structure as described facilitates adjustment or repair conducted by a dealer or the manufacturer. Namely, the unit structure enables the person in charge to correctly diagnose the components of the whole unit and, after the repair, delicately adjust the components in relation to one another, thereby recovering and maintaining the initial performance. This also enables the user to easily replace the unit with a new one. Hitherto, the components such as the developing section, transfer section and fixing section are constructed as separate units which are independently renewable. If the initial performance could not be recovered even by a renewal of one of these units, therefore, the users were often tempted to renew other unit or units, resulting in uneconomical use of the components and shortened period of maintenance. This problem can be overcome and the period of maintenance can be prolonged by the described embodiment in which components are constructed in one unit for simultaneous replacement.

In general, the pressing roller 3 in the transfer/fixing section has a much longer life than the heat-resistant belt 5 and the heat-generating element 4. In this embodiment, therefore, the pressure roller 3 is mounted separately from the above-mentioned unit frame 51 so as to be used without renewal, although this roller may be mounted on the unit frame 51 for renewal simultaneous with the renewal of other components such as the heat-resistant belt 5 and the heat-generating member 4.

Referring again to FIGS. 1 and 2, first and second timing sensors 37 and 38 are disposed in the vicinity of the pressure roller 3 at upstream and downstream sides, respectively, of the transfer/fixing section, i.e., the heat-fixing portion, as viewed in the direction of movement of the recording medium, i.e., the paper sheets 1. These sensors 37 and 38 respectively sense the leading edge of the paper sheet 1 approaching the heat-fixing position and the trailing edge of the paper sheet 1 leaving the heat-fixing position. These sensors 37 and 38 are electrically connected to the control unit 22. The control unit 22 operates in response to signals from the sensors 37 and 38 so as to control the heat-generating member 4 in such a manner that the heat-generating member 4 is energized to enable the transfer of a toner image from the heat-resistant belt 5 to a paper sheet 1 only when the paper sheet 1 is passing through the heat-fixing position. When no sheet exists in the heat-fixing position, the heat-generating member 4 is kept de-energized, whereby electrical power consumption is appreciably reduced.

The use of such sensors 37 and 38, however, is not essential, and a similar control is possible by using, for example, control data stored in the control unit 22.

Figure 7:
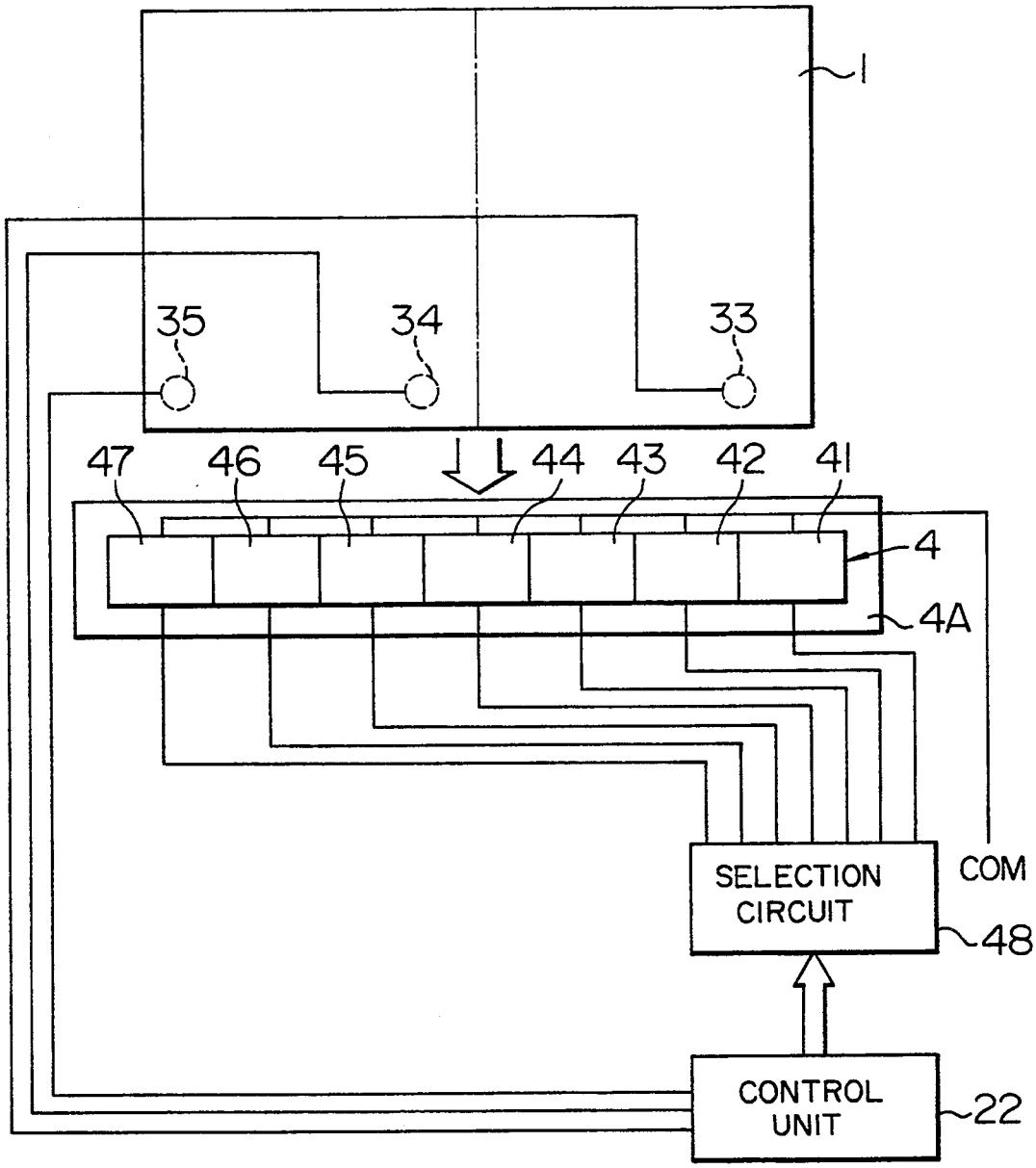
FIG. 7 is a block diagram showing electrical connections between a heater, a control unit and paper size sensors used in the first and second embodiments.

Referring now to FIG. 7 showing a specific embodiment, the heat-generating member 4 is composed of a row of heat-generating segments 41 to 47. The row extends transversely of the direction of movement of paper sheets 1. These heat-generating segments are independently selectable for energization by a selection circuit 48 which is under the control of the control unit 22. A plurality of size sensors 33 to 35 are disposed in a row which extends transversely of the path of movement of the recording paper sheets 1. Three such sensors 33–35 are employed in the embodiment shown in FIG. 7. These sensors 33 to 35 are electrically connected to the control unit 22. The control unit 22, upon receipt of a signal from one of the size sensors 33 to 35, determines the size of the paper sheet 1 which is going to be fed into the heat-fixing position, and decides the heat-generating segments to be energized, out of the segments 41 to 47. The result of the decision is transmitted to the selection circuit 48 which selects the heat-generating segments to be energized, so that only the heat-generating segments corresponding to the size of the paper sheet 1 are energized. Thus, heat-generating segments which are out of the area of the paper sheets 1 are not energized, so that the power consumption can be saved appreciably.

Figure 8:
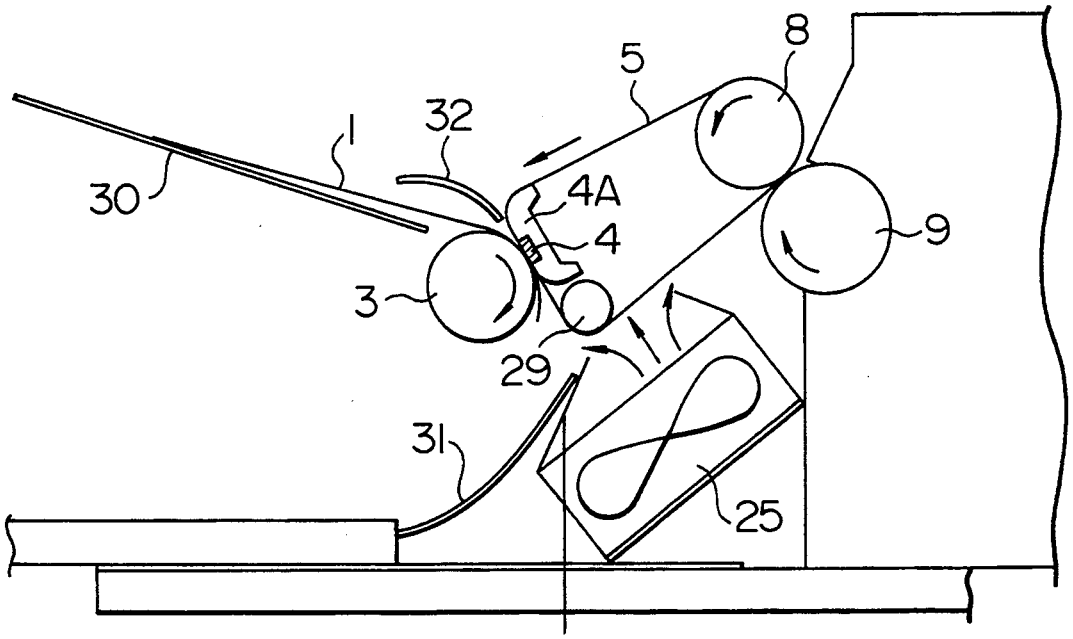
FIG. 8 is a fragmentary schematic side elevational view of a third embodiment of the electrophotographic copying apparatus in accordance with the present invention.

Referring to FIG. 8 showing a different embodiment, the heat-resistant belt 5 extends around and in contact with the driving drum 8, one side edge of the holder 4A holding the heat-generating member 4 and a separation roller 29 which is disposed in the vicinity of the other side edge of the holder 4A. The separation roller 29 is effective to reduce the friction between the holder *4a* and the heat-generating belt 5. Paper feed guides 30 and 32 are provided for guiding paper sheets 1 into the heat-fixing portion, while a paper ejection guide 31 is provided for guiding the paper sheets delivered from the heat-fixing portion.

In this embodiment, the photosensitive drum 9 is disposed upstream of the driving drum 8 as viewed in the direction of running of the heat-resistant belt 5. In this arrangement, the belt portion emerging from the heat-fixing portion runs only a small distance and, hence, cannot be sufficiently cooled before entering the toner-image receiving section where it receives the toner image from the photosensitive drum 9. It is, therefore, necessary to forcibly cool the heat-resistant belt 5. To this end, a blower 25 directs cooling air to the outer surface of the heat-resistant belt 5 going around the separation roller 29. Consequently, the belt portion emerging from the heat-fixing section can be sufficiently cooled before reaching the photosensitive drum 9, thus eliminating troubles such as damaging of the photosensitive drum 9 by heat.

Figure 9:
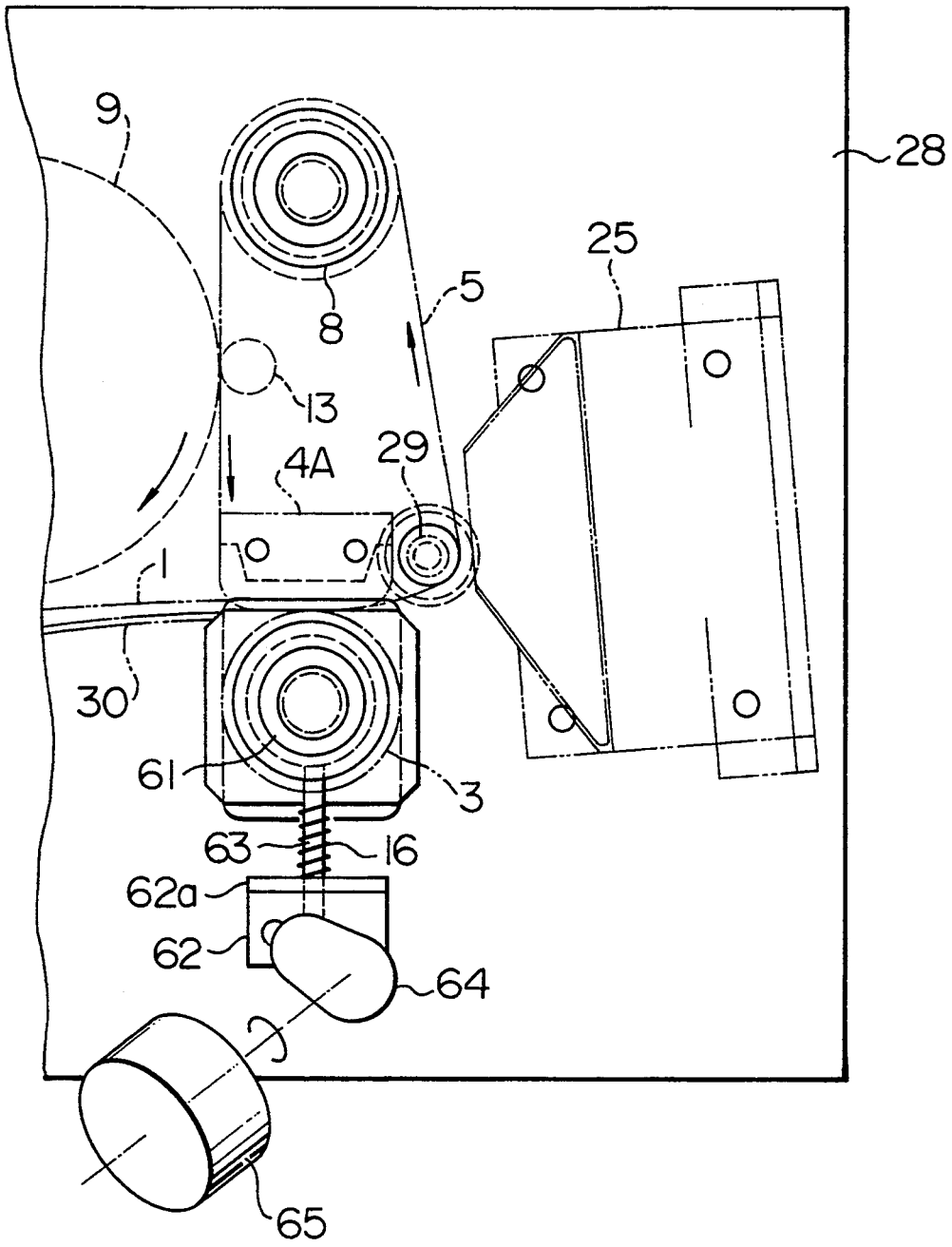
FIG. 9 is a fragmentary schematic side elevational view of a fourth embodiment of the electrophotographic copying apparatus in accordance with the present invention.

FIG. 9 is a side elevational view of the electrophotographic copying apparatus as viewed from the exterior of one of the side frame walls 28. The holder 4A holding the heat-generating member 4 is fixed at its each end to the associated side frame wall 28 by means of a screw or the like. Each end of the pressure roller 3 is mounted on the adjacent frame wall 28 through a bearing 61 adjustable up and down, i.e., towards and away from the holder 4A. A bracket 62 is fixed to one side of the frame wall 28. A rod 63 slidably extends through a bore formed in a horizontal portion **62*a* of the bracket 62. A compression spring 16 surrounding the rod 63 is loaded to act between the upper surface of the horizontal portion 62*a* of the bracket 62 and the lower side of the bearing 61, so as to urge the pressure roller 3 towards the heat-generating member 4 held by the holder 4A. The lower end of the rod 63 is held in contact with the peripheral surface of an eccentric cam 64 rotatably mounted on the side frame wall 28. The eccentric cam 64 is driven or rotated by a motor 65. When a recording medium having a large thickness is going to be fed into the heat-fixing portion, the motor 65 is energized to drive the cam 64 in such a direction as to weaken the pressing force exerted by the pressure roller 3. When the surface of the recording medium is rather rough, the motor 65 drives the cam 64 in such a direction as to increase the pressing force exerted by the pressing roller 3. The control of the operation of the motor 65 may be effected manually by the operator or automatically by the control unit 22. For enabling the automatic control of the motor 65, a thickness sensor and a smoothness sensor (both not shown) are disposed upstream of the heat-fixing portion and secured to, for example, the paper feed guide 30, so as to produce a thickness signal and a smoothness signal in accordance with which the control unit 22 operates to energize the motor 63 so as to optimize the pressure exerted by the pressure roller 3**. This embodiment, therefore, enables images to be transferred and fixed to a recording medium having a large thickness, e.g., a notebook and to a recording medium which has rough surface, without impairing the quality of printed images.

As will be understood from the foregoing description, the electrophotographic copying apparatus in accordance with the present invention does not require any means for conveying the recording medium from the transfer means to the fixing means since the transfer means and the fixing means are united with each other to enable transfer and fixing of image to be performed simultaneously.

Consequently, the size of the whole apparatus can be appreciably reduced. In addition, since the transfer and fixing of an image are conducted simultaneously at the same position, it is possible to avoid any misregistration between the toner image and a paper sheet, thus contributing to improvement in the quality of printed images.

What is claimed is:

1. An electrophotographic apparatus, comprising:

a photosensitive member:

developing means for forming, on said photosensitive member, a toner image of information to be recorded;

transfer means for transferring said toner image from said photosensitive member to a ribbon-shaped toner image carrier comprising a heat-resistant endless belt which includes a web of metal;

carrier driving means for driving said toner image carrier to a heat-fixing position, said carrier driving means including a driving drum engaging with an inner surface of a loop of said heat-resistant endless belt;

recording medium feeding means for feeding a sheet-type recording medium to said heat-fixing position;

transfer/fixing means disposed in said heat-fixing position for superposing said recording medium and said toner-image carrier one on the other and for applying heat and pressure to said toner image carrier and said recording medium thereby transferring said toner image from said toner-image carrier to said recording medium, and fixing the transferred image to said recording medium, said transfer/fixing means including a plate-like heating member spaced from said driving drum and disposed adjacent the inner surface of said loop of said heat-resistant endless belt and a pressure roller which is disposed to oppose said heating member so as to press the superposed sheet-type recording medium and said endless belt against said heating member at least during the toner-image transferring and fixing operation; and cooling means for cooling the portion of said heat-resistant endless belt which has passed through said heat-fixing position and has been separated from said sheet-type recording medium, said cooling means being disposed adjacent a path of travel of said portion of said endless belt from said heat-fixing position to said photosensitive member to protect said photosensitive member against heat applied by said heating member to said endless belt portion.

2. An electrophotographic apparatus according to claim 1, wherein said heat-resistant endless belt has a surface coated with at least one of a fluororesin and a resin having high electric resistivity.

3. An electrophotographic apparatus according to claim 1, wherein said plate-like heating member is a PTC heater held by a heater holder.

4. An electrophotographic apparatus according to claim 1, wherein said pressure roller has an outer peripheral layer made of an elastic material and wherein an area of contact between said outer peripheral layer of said pressure roller and said sheet-type recording medium is at least equal to an area of the region on said platelike heating member where the temperature thereof is higher than a toner fixing temperature.

5. An electrophotographic apparatus, comprising:

a photosensitive member;

developing means disposed in a developing position and capable of forming, on said photosensitive member, a toner image of information to be recorded;

first driving means for driving said photosensitive member from said developing position to a transfer position;

a heat-resistant ribbon-shaped toner image carrier movable from said transfer position to a heat-fixing position, said toner image carrier comprising a heat-resistant endless belt which includes a web of metal:

transfer means disposed in said transfer position for transferring said toner image from said photosensitive member to said toner image carrier;

second driving means for driving said toner-image carrier from said transfer position to said heat-fixing position;

recording medium feeding means for feeding a sheet-type recording medium into said heat-fixing position;

transfer/fixing means disposed in said heat-fixing position and operative to superpose said recording medium and said toner-image carrier one on the other and to transfer said toner image from said toner-image carrier to said recording medium and fix the thus transferred toner image to said recording medium, said transfer/fixing means including a plate-like heating member disposed in contact with the surface of said toner-image carrier opposite to the image-carrying surface to heat said toner-image carrier, and a heat-resistant roller for pressing said recording medium onto said image-carrying surface of said toner-image carrier at least during a toner image transferring and fixing operation; and cooling means for cooling the portion of said heat-resistant endless belt which has passed through said heat-fixing position and has been separated from said sheet-type recording medium, said cooling means being disposed adjacent a path of travel of said portion of said endless belt from said heat-fixing position to said photosensitive member to protect said photosensitive member against heat applied by said heating member to said endless belt portion.

6. An electrophotographic apparatus according to claim 5, wherein said second driving means includes a driving drum engaging with the inner surface of a loop of said heat-resistant endless belt, and wherein said photosensitive member is a photosensitive drum and said transfer means includes a rotary member which presses said heat-resistant endless belt onto said photosensitive drum.

7. An electrophotographic apparatus according to claim 5, wherein said transfer/fixing means includes pressing force adjusting means for adjusting the pressure between said toner image carrier and said roller in accordance with at least one of the thickness of said recording medium and the smoothness of the surface of said recording medium.

8. An electrophotographic apparatus according to claim 5, wherein said transfer/fixing means further includes distance adjusting means for adjusting the distance between said heating member and an axis of rotation of said roller in accordance with the thickness of said recording medium.

9. An electrophotographic apparatus, comprising:

a photosensitive member;

developing means disposed in a developing position and capable of forming, on said photosensitive member, a toner image of information to be recorded;

driving means for driving said photosensitive member from said developing position to a transfer position;

a heat-resistant endless belt having a run extending at least between said transfer position and a heat-fixing position, said endless belt comprising a web of metal;

a transfer means disposed in said transfer position for transferring said toner image from said photosensitive member to said run of said endless belt;

a driving drum disposed in engagement with an inner surface of a loop of said heat-resistant endless belt so as to drive, from said transfer position to said heat-fixing position, the run of said heat-resistant endless belt which has received the toner image;

recording medium feeding means for feeding a sheet-type recording medium into said heat-fixing position;

transfer/fixing means disposed in said heat-fixing position and operative to superpose said recording medium and said run of said heat-resistant endless belt one on the other and to transfer said toner image for said endless belt of said recording medium and fixing the transferred toner image to said recording medium;

control means for controlling the operations of said driving means, said driving drum and said recording medium feeding means;

said transfer/fixing means including a plate-like heating member disposed in contact with an inner surface of a loop of said endless belt opposite to the image-carrying surface to heat said endless belt, and a heat-resistant roller for pressing said recording medium onto said image-carrying surface of said loop of said heat-resistant endless belt, at least during a toner-image transferring and fixing operation; and cooling means for cooling the portion of said heat-resistant endless belt which has passed through said heat-fixing position and has been separated from said sheet-type recording medium, said cooling means being disposed adjacent a path of travel of said portion of said endless belt from said heat-fixing position to said photosensitive member to protect said photosensitive member against heat applied by said heating member to said endless belt portion.

10. An electrophotographic apparatus according to claim 9, wherein said heating member is an electrically energizable heat-generating member, and wherein said control means includes timing sensing means for sensing the passage of said recording medium through said heat-fixing position and controls the operation of said heat-generating member in a timed relationship with the sensed passage of said recording medium.

11. An electrophotographic apparatus according to claim 10, wherein said timing sensing means includes first and second timing sensors which are respectively disposed upstream and down stream of said heat-fixing position as viewed in the direction of feed of said sheet-type recording medium, so as to sense a leading edge of a sheet-type recording medium which is going to enter said heat-fixing position and a trailing edge of the sheet-type recording medium which has just left said heat-fixing position.

12. An electrophotographic apparatus according to claim 9, wherein said heating member is an electrically-energizable heat-generating member, and wherein said control means includes size sensing means for measuring the size of said sheet-type recording medium in the direction transverse to the feeding direction thereof and controls a heat-generating region of said heat-generating member in accordance with the size of said recording medium as measured by said size sensing means.

13. An electrophotographic apparatus according to claim 9, wherein said cooling means includes a cooling fluid passage hole formed in said driving drum so as to allow a cooling fluid to flow through said driving drum.

14. An electrophotographic apparatus according to claim 9, wherein said cooling means includes cooling fluid applying means disposed to direct cooling fluid to said heat-resistant endless belt running between said heat-fixing position and said transfer position.

15. An electrophotographic apparatus according to claim 9, wherein said control means includes a temperature sensor for sensing the temperature of said heat-resistant endless belt running between said heat-fixing position and said transfer position, said control means suspending the operations of at least said developing member and said heating means when the temperature sensed by said temperature sensor is higher than a predetermined temperature level.

16. An electrophotographic apparatus, comprising:

a photosensitive drum;

a developing device for forming, on said photosensitive drum, a toner image of information to be recorded:

a heat-resistant endless belt having a run extending from said transfer position to a heat-fixing position, said endless belt comprising a web of metal;

a transfer roller for transferring the toner image from said photosensitive drum to said heat-resistant endless belt;

a driving drum engaging with an inner surface of a loop of said heat-resistant endless belt so as to drive, from said transfer position to said heat-fixing position, the run of said heat-resistant endless belt which has received said toner image;

recording medium feeding means for feeding a sheet-type recording medium to said heat-fixing position;

transfer/fixing means disposed in said heat-fixing position and operative to superimpose said sheet-type recording medium and said run of said heat-resistant endless belt one on the other and to transfer said toner image from said heat-resistant endless belt to said sheet-type recording medium and fix the transferred image to said sheet-type recording medium, said transfer/fixing means including heating means disposed in contact with the inner surface of the loop of said heat-resistant endless belt to heat said heat-resistant endless belt, said heating means including an electrically energizable plate-like heating member;

wherein said photosensitive drum, said heat-resistant endless belt, said transfer roller, said driving drum and said heating means are mounted on a common frame which is detachable from a frame of the apparatus; and cooling means for cooling the portion of said heat-resistant endless belt which has passed through said heat-fixing position and has been separated from said sheet-type medium, said cooling means being disposed adjacent a path of travel of said portion of said endless belt from said heat-fixing position to said photosensitive member to protect said photosensitive member against heat applied by said heating member to said endless belt portion.

17. An electrophotographic apparatus according to claim 16, wherein said transfer/fixing means further includes a pressure roller for pressing said recording medium onto the outer surface of the loop of said endless belt, said pressure roller being mounted on said frame of said apparatus.

18. An electrophotographic apparatus according to claim 17, wherein said transfer/fixing means further includes disengaging means for disengaging said pressure roller from said loop of said endless belt before said common frame is demounted from said frame of said apparatus.

19. An electrophotographic apparatus according to claim 18, wherein said disengaging means includes a pressure roller supporting member rotatably supporting said pressure roller and pivotally secured to said frame of the apparatus, a compression spring loaded between said pressure roller supporting member and said frame of the apparatus, and actuator means for actuating, before said common frame is demounted from the frame of the apparatus, said pressure roller supporting member against the force of said spring so as to move said pressure roller away from the loop of said heat-resistant endless belt.

20. An electrophotographic apparatus according to claim 19, wherein said actuator means includes a cam and an actuator for actuating said cam.

21. An electrophotographic apparatus according to claim 19, wherein said frame of the apparatus has guide rail means mounted thereon for guiding said common frame during mounting and demounting thereof.

* * * * *